United States Patent [19]

Bounds

[11] Patent Number: 4,461,234

[45] Date of Patent: Jul. 24, 1984

[54] FLAG WAVING MACHINE

[76] Inventor: William E. Bounds, P.O. Box 1547, Torrance, Calif. 90505

[21] Appl. No.: 436,268

[22] Filed: Oct. 25, 1982

[51] Int. Cl.[3] ..... G09F 17/00

[52] U.S. Cl. ..... 116/173; 74/25; 116/174

[58] Field of Search ..... 116/285, 284, 173, 63 R; 74/42, 44, 25; 40/415, 411

[56] References Cited

U.S. PATENT DOCUMENTS 2,284,209 5/1942 Holm ..... 116/173
3,995,580 12/1976 Serrone ..... 116/173

FOREIGN PATENT DOCUMENTS 540655 12/1956 Fed. Rep. of Germany ..... 116/173
11853 of 1900 United Kingdom ..... 116/173

*Primary Examiner*—Charles Frankfort
*Assistant Examiner*—Denis E. Corr
*Attorney, Agent, or Firm*—Edward A. Sokolski

[57] ABSTRACT

A flag waving machine for automatically waving a flag in a figure 8 pattern. A rod provides a support for the flag to be waved, this rod being attached to a pitman arm through a universal joint, the rod being pivotally supported in a bushing. The pitman arm is rotatably driven at one end to provide reciprocal motion of the rod, this reciprocal motion being guided in a figure 8 pattern by means of a guide channel. The channel is formed between a figure 8 shaped wall formed on a base member and a pair of spring-urged elliptical guide members which are also shaped and positioned to form a figure 8, the guide members operating to guide the path of the arm in the channel through a figure 8 pattern.

8 Claims, 5 Drawing Figures

FLAG WAVING MACHINE

This invention relates to a machine for automatically waving a flag, and more particularly to such a device which guides the motion of a flag in a figure 8 pattern.

When a flag is manually waved, the ideal motion for such waving is in the form of a figure 8 which keeps the flag from becoming furled and provides a motion which keeps the flag in an outstretched condition similar to that afforded when a good breeze is blowing. The device of the present invention provides means for waving a flag in this ideal figure 8 pattern in response to a motor drive mechanism wherein this ideal figure 8 pattern is achieved automatically. The device of this invention thus provides a novelty item with a patriotic flair which can be used both on desk tops or other indoor locations or to drive larger flags in an outdoor display. This waving of the flag in this manner distinctly enhances the display of the flag, providing a dynamic, dramatic effect not afforded when the flag is in a static condition.

It is therefore an object of this invention to provide means for enhancing the display of a flag.

It is a further object of this invention to provide a device for automatically waving a flag in a figure 8 pattern.

Other objects of this invention will become apparent as the description proceeds in connection with the accompanying drawings of which:

Figures 1, 5:
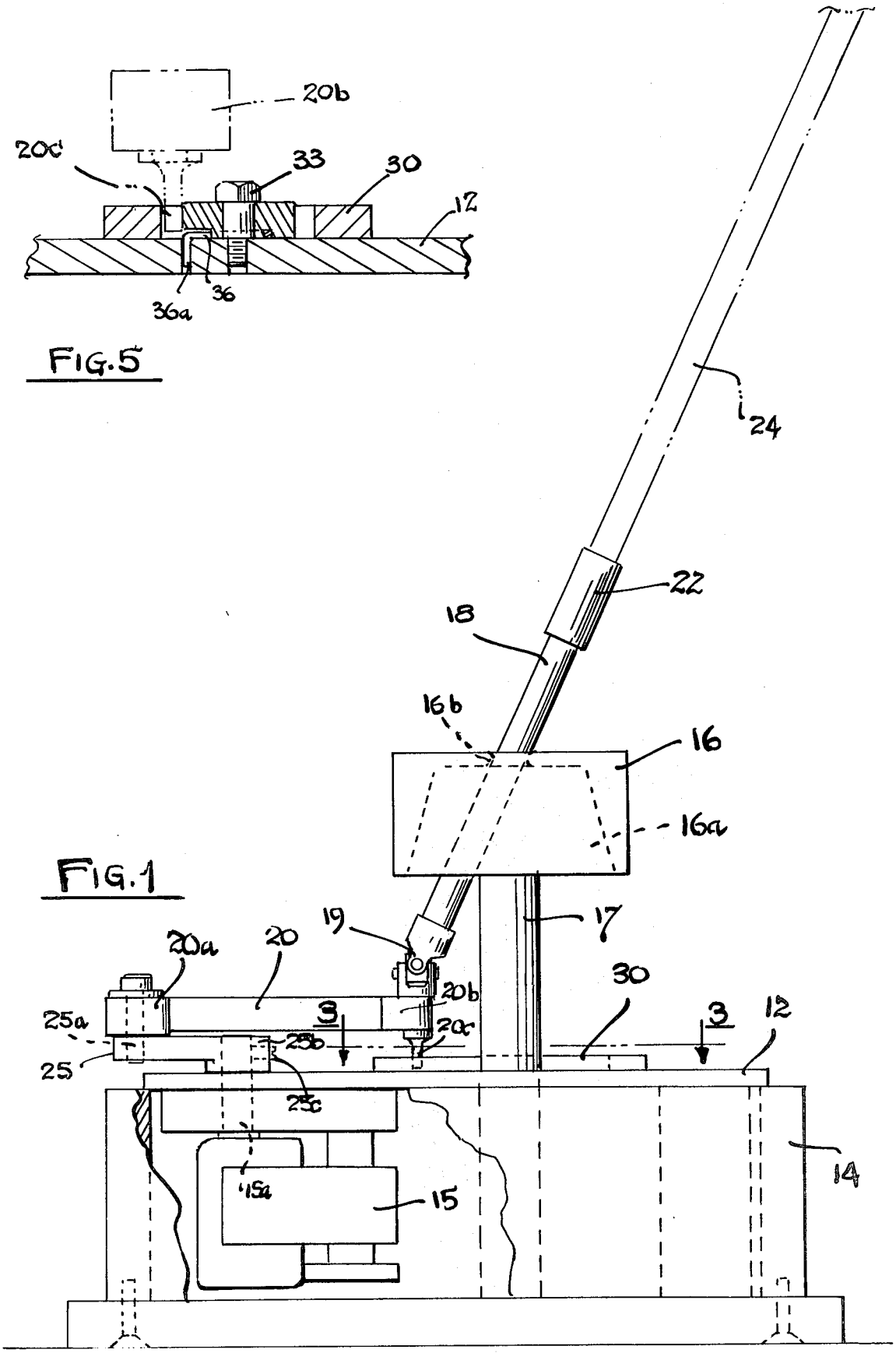
FIG. 1 is an elevational view of a first embodiment of the invention.
FIG. 5 is a cross-sectional view taken along the plane indicated by 5—5 in FIG. 4.
Figure 2:
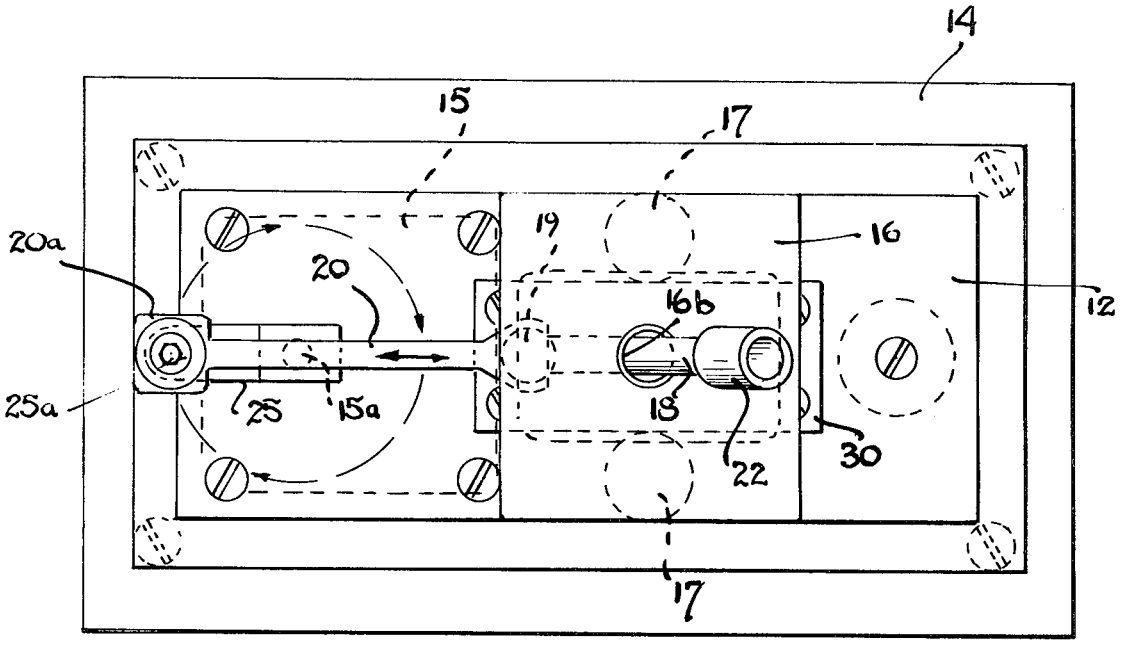
FIG. 2 is a top plan view of the first embodiment.

Referring now to the figures, a preferred embodiment of the invention is illustrated. Base plate 12 is fixedly supported on stand 14 which also provides a housing for electric motor 15. Supported on base plate 12 by means of posts 17 is a block member 16 which has a hollowed out center portion 16*a* and an elongated aperture 16*b* formed in the top wall thereof. Fitted through aperture 16*b* is a shaft or rod 18 which is connected by means of universal joint 19 to pitman arm 20. Shaft 18 has a receptacle 22 attached to the end thereof and into which the staff 24 of a flag (not shown) is fitted. One end 20*a* of pitman arm 20 is pivotally connected to one end of crank arm 25 by means of pivot pin 25*a* on the end of the crank which fits in a sleeve bearing formed in crank end portion 20*a*. Fixedly attached to the opposite end 20*b* of pitman arm 20 is a pin member 20*c*. The end portion 25*b* of crank arm 25 is fixedly attached by means of set screw 25*c* to the drive shaft 15*a* of electric motor 15. Thus, the rotatable drive of motor 15 is converted to reciprocal motion by means of pitman arm 20. This reciprocal motion is converted to figure 8 motion by means of the channelling mechanism illustrated in FIGS. 3–5. Fixedly mounted on base plate 12 is a channelled plate 30 having a central portion 30*a* thereof milled out in the general form of an hourglass. Pivotally supported at the center of each of the half sections of the hourglass shaped opening 30*a* is a generally elliptically shaped guide member 32, these members being pivotally mounted on bolts 33 fixedly attached to plate 30. The guide members 32 are resiliently urged against the wall 30*b* on one side of opening 30*a* by means of coil springs 36, one of which can be seen in FIGS. 4 and 5. One end 36*a* of each of such springs abuts against a slotted wall portion of plate 30 while the other end of the spring 36*b* fits in a groove formed in the guide members 32 and abuts against a wall thereof, as best can be seen in FIG. 4. Thus, both of the guide members 32 are resiliently urged by the springs against a wall 30*b* of opening 30*a* as illustrated in FIG. 3.

Figure 3:
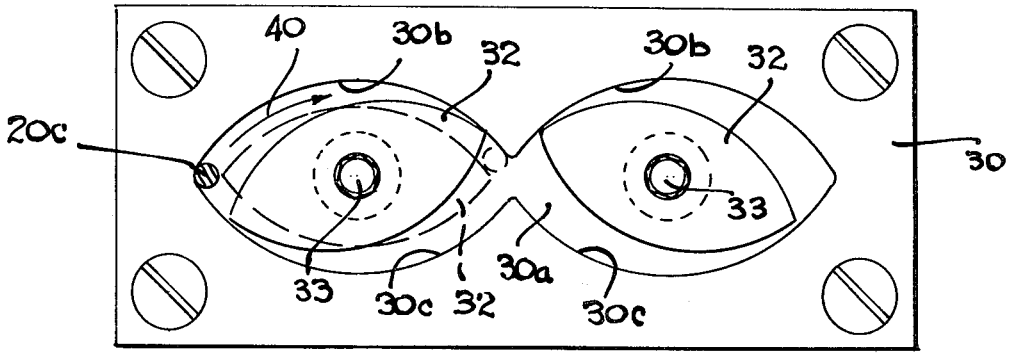
FIG. 3 is a view taken along the plane indicated by 3—3 in FIG. 1.
Figure 4:
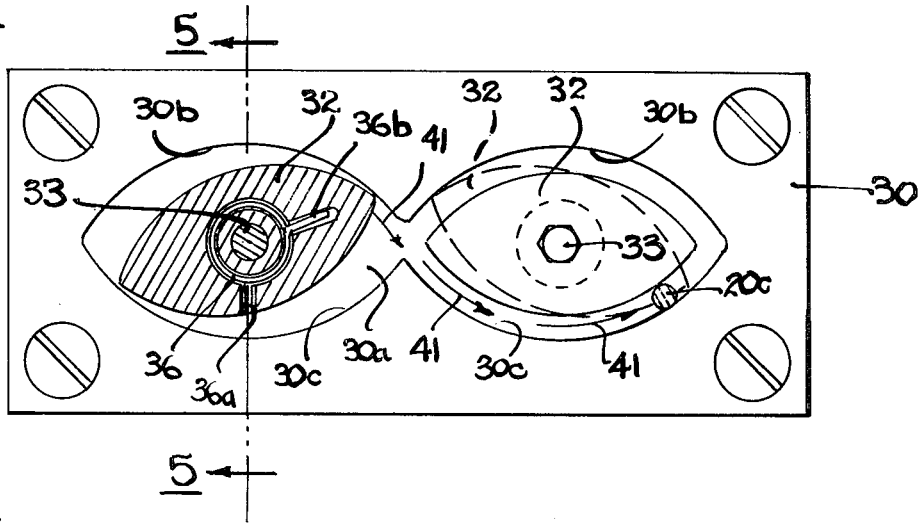
FIG. 4 is a top plan view with partial cutaway section of one of the cam members illustrating the cam member in a position different from that shown in FIG. 3.

Pin 20*c* of pitman arm 20 rides in the channel formed between the guide members 32 and the wall of opening 30*a* and is guided by the guide members 32 to travel in a figure 8 pattern, as can be seen by reference to FIGS. 3 and 4. As shown in FIG. 3, pin 20*c* is to the far left of the channel and is moving in the direction indicated by arrow 40. When the pin moves to the right, it resiliently urges the left-hand guide member 32 downwardly, as indicated by the dotted outline thereof, and is guided downwardly by the guide member so that it travels to the opposite side 30*c* of the opening, as indicated by arrows 41 in FIG. 4. Pin member 20*c* then resiliently urges the right-hand guide member 32 away from the lower wall as illustrated in FIG. 4, and from this position moves around the end of the guide member over to the opposing wall 30*b* of the opening. The pin 20*c* then rides around in the channel formed between the guide members 32 and the wall of opening 30*a* in an opposite direction, in the same general manner as just described. Thus, a figure 8 motion is achieved to obtain an optimum waving action of the flag supported on staff 24.

While the invention has been described and illustrated in detail, it is to be clearly understood that this is intended by way of illustration and example only and is not to be taken by way of limitation, the spirit and scope of the invention being limited only by the scope of the following claims.

I claim:

1. A flag waving machine for waving a flag support on a staff comprising a plate member having an hourglass-shaped opening formed therein, means for fixedly supporting said plate member, a pair of similar elliptically shaped guide members pivotally mounted in end-to-end relationship on said plate member within the opening formed therein, a channel being formed between said guide members and the wall of said plate member opening, means for resiliently urging said guide members against one side of the wall of said plate member opening, rod means for supporting the staff of said flag, means for pivotally supporting said rod means, pin means coupled to said rod means, said pin means riding in the channel formed between guide members and the wall of the plate member opening, and means for reciprocally driving said rod means such that the pin means rides reciprocally in said channel with said guide members guiding the path of said pin means in said channel in a figure eight pattern.

2. The machine of claim 1 wherein the means for fixedly supporting said plate member comprises a stand to which the plate member is attached.

3. The machine of claim 2 wherein said means for pivotally supporting the rod means comprises a hollowed out block member having an elongated aperture formed therein through which the rod means extends, said block member being fixedly supported on said stand.

4. The machine of claim 1 and further including a universal joint for coupling the pin means to the rod means.

5. The machine of claim 1 wherein said means for reciprocally driving the rod means comprises a pitman arm coupled at one end thereof to said rod means, and motor means for rotatably driving the other end of said pitman arm.

6. The machine of claim 1 wherein the means for resiliently urging said guide members comprises coil spring means for resiliently driving each of said guide members.

7. The machine of claim 1 wherein said rod means comprises a rod member and receptacle means attached to one end of said rod member for receiving the staff of the flag.

8. The machine of claim 7 and further including universal joint means for coupling the other end of said rod member to said pin means.

* * * * *